US009073328B2

(12) United States Patent
La Vos et al.

(10) Patent No.: US 9,073,328 B2
(45) Date of Patent: Jul. 7, 2015

(54) INKJET MARKING MODULE AND METHOD FOR CONDITIONING INKJET MARKING MODULE

(71) Applicant: OCE-TECHNOLOGIES B.V., Venlo (NL)

(72) Inventors: Peter G. La Vos, Baarlo (NL); Cornelis J. Groenenberg, Venlo (NL)

(73) Assignee: OCÉ-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 14/475,057

(22) Filed: Sep. 2, 2014

(65) Prior Publication Data

US 2014/0368574 A1 Dec. 18, 2014

Related U.S. Application Data

(63) Continuation of application No. PCT/EP2013/053563, filed on Feb. 22, 2013.

(30) Foreign Application Priority Data

Mar. 2, 2012 (EP) ..... 12157848

(51) Int. Cl.
*B41J 2/165* (2006.01)

(52) U.S. Cl.
CPC ..... *B41J 2/16552* (2013.01); *B41J 2/165* (2013.01); *B41J 2002/16555* (2013.01)

(58) Field of Classification Search
CPC ..... B41J 2/165; B41J 2/16555; B41J 2/16552
USPC ..... 347/20, 25, 26, 102
See application file for complete search history.

(56) References Cited

U.S. PATENT DOCUMENTS

| | | | | |
|---|---|---|---|---|
| 5,929,877 | A | 7/1999 | Hetzer et al. | |
| 7,604,322 | B2 | 10/2009 | Silverbrook et al. | |
| 2007/0285456 | A1 | 12/2007 | Takasu et al. | |
| 2011/0115863 | A1 * | 5/2011 | Suzuki et al. | 347/102 |

FOREIGN PATENT DOCUMENTS

| | | | |
|---|---|---|---|
| EP | 2322348 | A1 | 5/2011 |
| JP | 2006-44021 | A | 2/2006 |

* cited by examiner

*Primary Examiner* — Sarah Al Hashimi
(74) *Attorney, Agent, or Firm* — Birch, Stewart, Kolasch & Birch, LLP

(57) ABSTRACT

An inkjet marking module includes an inkjet marking device adapted to jet droplets of an inkjet marking material to form an image on recording substrate; and an evaporation device arranged for evaporating a solvent to a gaseous medium. The evaporation device includes an aerosol generator for creating an aerosol of the solvent in the gaseous medium; and a droplet eliminator for removing droplets from the aerosol, the droplet eliminator being arranged downstream of the aerosol generator. A printing system includes such an inkjet marking module and a method is disclosed for controlling the relative degree of saturation of a solvent vapor in a gaseous medium in an inkjet marking module.

11 Claims, 6 Drawing Sheets

INKJET MARKING MODULE AND METHOD FOR CONDITIONING INKJET MARKING MODULE

CROSS-REFERENCE TO RELATED APPLICATIONS

This application is a Continuation of International Application No. PCT/EP2013/053563, filed on Feb. 22, 2013, and for which priority is claimed under 35 U.S.C. §120. PCT/EP2013/053563 claims priority under 35 U.S.C. §119(a) to Application No. 12157848.8, filed in Europe on Mar. 2, 2012. The entire contents of each of the above-identified applications are hereby incorporated by reference into the present application.

BACKGROUND OF THE INVENTION

1. Field of the Invention

The present invention relates to an inkjet marking module comprising an inkjet marking device being adapted to jet droplets of an inkjet marking material to form an image on recording substrate; and an evaporation device arranged for evaporating a solvent in a gaseous medium, the evaporation device being arranged to control the vapor pressure of a solvent vapor in a gaseous medium present in the printing module within a predetermined range in order to prevent drying of the inkjet marking material in or on the inkjet marking device, hence preventing deterioration of the jetting properties of the inkjet marking device. The present invention also relates to a printing system comprising such an inkjet marking module and a method for controlling the vapor pressure of a solvent vapor in a gaseous medium in such an inkjet marking module.

2. Description of Background Art

Deterioration of jetting properties of an inkjet printing device (inkjet head of printhead) is a known problem in the background art. It is also known that nozzle clogging of inkjet heads with dried ink residues and depositions of dried ink residues on a nozzle plate near the nozzles cause jetting properties to deteriorate. Ink residues causing nozzle clogging and said depositions are generated due to evaporation of solvents from the ink composition present in the nozzles and on the nozzle plate. To solve the problem of evaporation of solvents from the ink, the background art suggests providing a micro-climate in the nozzle region of the inkjet printing devices. The micro-climate is provided by supplying air enriched with solvent vapors to said nozzle region (see for example U.S. Pat. No. 5,929,877, U.S. Pat. No. 7,604,322 and U.S. Application Publication No. 2007/0285456). The micro-climate prevents evaporation of the solvents present in the ink in the nozzle region and hence ink residues do not dry out. Clogging is effectively reduced and depositions of ink residues on the nozzle plate can be easily wiped off.

In the case of water based inks (solvent is water) the micro-climate is provided by supplying air enriched with water vapor (see U.S. Application No. 2007/0285456). In this published U.S. patent application, it is also disclosed that for controlling the humidity in the nozzle region, a humidity detection portion (i.e. one or more humidity sensors), is arranged for periodically measuring the relative humidity (RH) in the nozzle region when an ink carriage comprising an ink cartridge passes said humidity detection portion in a scanning printing process.

In U.S. Application Publication No. 2011/0115863, a humidifying unit that generates humidified gas and the use thereof in an apparatus also including a drying unit and a recording unit are disclosed. It is also disclosed that the humidifying performance is feed-back controlled by a control unit on the basis of a humidity sensor, so that the humidified gas at an appropriate humidity can be generated.

A disadvantage of the humidifying methods and devices as disclosed in U.S. Application Publication No. 2007/0285456 and U.S. Application Publication No. 2011/0115863 is that humidity sensors are not capable of preventing super-saturation or even condensation if the RH to be controlled (setpoint of the humidity sensor) deviates from 100% (e.g. saturation) by less than the accuracy of the humidity sensor. For example, at a humidity sensor accuracy of ±3 RH % (common for humidity sensors) and a setpoint of 98% RH, the controlled RH may vary within the range of between 95% and 101%, based on the measurement accuracy alone (thus not including oscillation around the setpoint). Therefore, adequate control of a RH near the saturation point while preventing supersaturation and/or condensation is not possible.

It is another disadvantage of the humidifying methods and devices as disclosed in U.S. Application Publication No. 2007/0285456 and U.S. Application Publication No. 2011/0115863 that directly controlling the air humidity based on humidity sensing is too slow in a high speed printing process, such that the air humidity in the nozzle region is not properly controlled, which may lead to drying out of ink residues and hence to nozzle clogging or to condensation, both deteriorating the jet properties.

It is yet another disadvantage of the humidifying method and device as disclosed in U.S. Application Publication No. 2007/0285456 that the arrangement of the humidity sensor is such that the relative humidity in a region near the nozzles is only periodically measured, when the ink carriage comprising the ink cartridge passes the humidity sensor. Continuous and accurate humidity control is therefore not possible.

SUMMARY OF THE INVENTION

It is an object of the present invention to provide an inkjet marking module suitable for accurately controlling the vapor pressure of a solvent vapor in a gaseous medium, in particular close to the saturated vapor pressure of said solvent vapor in the gaseous medium, in the nozzle region of an inkjet marking device (e.g. printhead), thereby solving or at least mitigating the disadvantages as described above.

It is another object of the present invention to provide a printing system comprising such an inkjet marking module.

It is yet another object of the present invention to provide a method for accurately controlling the vapor pressure of a solvent vapor in a gaseous medium in the nozzle region of an inkjet marking device.

These objects are at least partly achieved by providing an inkjet marking module comprising: an inkjet marking device being adapted to jet droplets of an inkjet marking material to form an image on a recording substrate; and an evaporation device arranged for evaporating a solvent in a gaseous medium, the evaporation device comprising an aerosol generator for creating an aerosol of the solvent in the gaseous medium; and a droplet eliminator for removing droplets from the aerosol, the droplet eliminator being arranged downstream of the aerosol generator.

An aerosol is a colloidal dispersion of fine solid particles or liquid droplets in a gas, with the gas being the continuous phase of the aerosol and the fine solid particles and/or liquid droplets being the dispersed phase. The size of the particles or droplets is preferably in the order of 1 μm.

The terms "downstream" and "upstream" in the context of the present invention should be construed as defining a location of a first element of a device relative to the location of a second element of the device, when the device is being operated. In operation a flow may be generated through the device. When the first element is arranged downstream of the second element, the flow through the device is directed from the second element to the first element. When the first element is arranged upstream of the second element, the flow through the device is directed from the first element to the second element.

In the evaporation device according to the present invention, the droplet eliminator is arranged downstream of the aerosol generator, meaning that in operation a flow may be generated through the evaporation device, which flow is directed from the aerosol generator to the droplet eliminator.

Therefore, an aerosol may be generated in a flow of a gaseous medium, which flow is directed towards the droplet eliminator. During the transport of the aerosol to the droplet eliminator, the liquid droplets of the solvent present in the aerosol are allowed to evaporate (to the gaseous medium) and create an increased vapor pressure of the solvent in the gaseous medium. The dispersed liquid droplets of solvent in the aerosol have a relatively large specific area (i.e. a large liquid-gas interface per unit of volume aerosol), so evaporation of the solvent is relatively quick. Therefore, before reaching the droplet eliminator, the relative humidity of the gaseous medium may be up to 100%. The remainder of the liquid droplets of the solvent present in the aerosol is then eliminated by the droplet eliminator. In other words, the droplet eliminator may be arranged for removing an excess of the liquid droplets of the solvent from the aerosol. The excess may be construed to be both the excess in number of droplets of the solvent in the aerosol and the remainder of a droplet that has partly evaporated and reaches the droplet eliminator. The flow of gaseous medium leaving the evaporation device may therefore be saturated with solvent vapor and is virtually free of solvent in liquid form.

The inkjet marking device comprises a nozzle region comprising at least one nozzle arranged for expelling droplets of the inkjet marking material to form the image on the recording substrate. The evaporation device may be arranged to provide the gaseous medium comprising solvent vapor in the nozzle region of the inkjet marking device.

The solvent vapor in the gaseous medium preferably is the same solvent used in the used ink composition.

Examples of an aerosol generator are a water spray humidifier or an ultrasonic aerosol generator. An ultrasonic aerosol generator may comprise a piezo electric element, which is arranged in a (liquid) solvent (e.g. water) reservoir below the interface of the solvent and the gaseous medium. By activating the piezo electric element, an ultrasonic wave is generated and liquid solvent droplets of about 1 μm may be released into the gaseous medium.

In an embodiment, the inkjet marking module comprises a flow device configured to create a flow of the gaseous medium through the evaporation device, e.g. a blowing device such as a fan.

In an embodiment, the inkjet marking module comprises a transporting mechanism configured to transport a sheet of a recording substrate, the transporting mechanism having an outer surface, wherein the flow device is a suction mechanism arranged to provide an underpressure force at an outer surface of the transporting mechanism.

In an embodiment, the droplet eliminator is a passive droplet eliminator.

In the context of the present invention, a passive droplet eliminator is to be construed as a droplet eliminator that does not contain moving parts arranged for removing droplets from the aerosol.

The passive droplet eliminator may comprise a mesh through which the aerosol is guided. The mesh acts as a sieve such that the droplets are eliminated from the aerosol and the gaseous medium substantially saturated with the solvent vapor remains.

In an embodiment, the droplet eliminator is an active droplet eliminator.

In the context of the present invention, an active droplet eliminator is to be construed as a droplet eliminator comprising a moving part, the moving part having a function of removing droplets from the aerosol, e.g. by centrifugal forces.

In an embodiment, the active droplet eliminator comprises a rotatable element, which in operation removes droplets from the aerosol.

In an embodiment, the rotatable element is a fan, the fan also being arranged for advancing the aerosol through the evaporation device.

An advantage of this embodiment is that the flow device may be dispensed with, because the fan according to the present embodiment creates a flow of the gaseous medium through the evaporation device. Therefore the flow device is optional in the present embodiment.

However, the inkjet marking module according to the present embodiment may comprise a flow device configured to create a flow through the device, e.g. a first fan, and an active droplet eliminator comprising a second fan as a rotatable element.

In an embodiment, the evaporation device comprises an evaporation chamber arranged downstream of the aerosol generator and upstream of the droplet eliminator.

In an embodiment, the evaporation device comprises a temperature sensor and a heat exchanger both operatively connected with a temperature controller.

The controller according to the present embodiment may be used to prevent a temperature drop of the aerosol due to the evaporation of the solvent droplets in the aerosol.

It is an additional advantage of the present embodiment that the substantially saturated gaseous medium may be formed at a (controlled) temperature below the temperature in the printing region. By using empirical correlations between the saturation pressure of the solvent vapor in the gaseous medium as a function of temperature, one is able to control the solvent vapor pressure (e.g. the relative humidity (RH) in case the solvent is water) in the printing region at a level close to saturation (e.g. RH below 100%), without using vapor pressure sensors (e.g. RH sensors). The control of the solvent vapor pressure in the printing region reduces to a temperature control in the printing region combined with a temperature control in the evaporation chamber.

In an embodiment, the evaporation device additionally comprises: a first mass flow controller arranged to control a first mass flow of the gaseous medium substantially saturated with the solvent vapor; a second mass flow controller arranged to control a second mass flow of the gaseous medium having a vapor pressure of the solvent vapor of below the saturation vapor pressure; and a duct arranged downstream of the first mass flow controller and the second mass flow controller and arranged for mixing the first mass flow with the second mass flow.

The evaporation device according to the present embodiment may comprise a vapor pressure sensor (e.g. a (relative) humidity sensor in case the solvent is water); a temperature sensor; and a heat exchanger. The temperature sensor and the heat exchanger are operatively connected to a temperature controller arranged for controlling the temperature of the second mass flow. The vapor pressure sensor is arranged for measuring the vapor pressure of the second mass flow (e.g. the (relative) humidity of ambient air), which is used to determine the mass flow ratio of the first mass flow controller and the second mass flow controller in order to obtain a combined air flow having vapor pressure of the solvent vapor within a predetermined region (e.g. a relative humidity within 80 and 95%). It is an advantage of the present embodiment that the control of the vapor pressure relative to the saturation vapor pressure of the solvent vapor in the gaseous medium (e.g. the relative humidity) in the printing region is reduced to a mass-flow-ratio control of a flow of the gaseous medium substantially saturated with solvent vapor, e.g. air substantially saturated with water vapor (first mass flow controller) and a flow of the gaseous medium having a vapor pressure of the solvent vapor of below the saturation vapor pressure, e.g. ambient air second (mass flow controller).

For example, the inkjet marking material may be an aqueous inkjet ink, e.g. a latex inkjet ink. Then, the solvent is water and the gaseous medium preferably is air. In the present example, the second flow of the gaseous medium may be ambient air, i.e. air obtained from the environment of the inkjet marking module.

Changes in the relative humidity of the ambient air will be gradual (e.g. due to changing weather conditions) relative to the time scale of (high speed) printing. Therefore such changes can be easily compensated for in the mass-flow-ratio control according to the present embodiment.

In another aspect, the present invention pertains to a printing system comprising an inkjet marking module according to any one of the above described embodiments.

In an embodiment, the printing system comprises a fixing and drying unit, wherein solvent enriched gaseous medium generated in the fixing and drying unit is transferred to the inkjet marking module.

Another aspect of the present invention pertains to a method for controlling the vapor pressure of a solvent vapor in a gaseous medium in an inkjet marking module as defined in any one of the embodiments described above, the method comprising the steps of: creating an aerosol of the solvent in liquid form in the gaseous medium; equilibrating the aerosol such that the gaseous medium saturates with solvent vapor; and removing solvent droplets from the aerosol.

This method provides a gaseous medium comprising an amount of solvent vapor close to the saturation point, i.e. the vapor pressure of the solvent vapor in the gaseous medium is close to the saturated vapor pressure of said solvent vapor in the gaseous medium, in a reliable manner. No sensors are required to measure the vapor pressure of the solvent vapor in the nozzle region of an inkjet head. The gaseous medium comprising the solvent vapor may be introduced in a printing region in the inkjet marking module, the printing region comprising said nozzle region. Due to the created microclimate of solvent vapor enriched gaseous medium in the printing region, evaporation of said solvent from an inkjet marking substance is prevented or at least mitigated. Therefore nozzle clogging and/or ink residue deposition on the inkjet marking device are prevented or at least mitigated. The method according to the present invention therefore enables continuous and accurate control of the solvent vapor pressure in a printing region close to the saturation vapor pressure while preventing super saturation and condensation.

Due to evaporation of the solvent present as a disperse phase in the aerosol, the temperature of the aerosol may slightly decrease. The air saturated with water which leaves the evaporation device may therefore have a slightly lower temperature than the environment of the inkjet marking device, in particular the printing region in which the humidified air may be (re)introduced. The risk of condensation of the solvent anywhere in the inkjet marking module has therefore significantly been reduced.

For example, the inkjet marking material may be an aqueous inkjet ink, e.g. a latex inkjet ink. Then, the solvent is water and the gaseous medium preferably is air. The method according to this embodiment then provides air substantially saturated with water vapor, without using RH-sensors to measure the relative humidity (e.g. vapor pressure relative to the saturation vapor pressure of water vapor in air) in the nozzle region of an inkjet head. The air substantially saturated with water vapor may be fed to a printing region comprising said nozzle region.

In an embodiment, the method comprises an additional step of introducing a first flow of the gaseous medium substantially saturated with the solvent vapor in a printing region.

In an embodiment, the method comprises the additional step of mixing the first flow of the gaseous medium substantially saturated with the solvent vapor with a second flow of the gaseous medium having a vapor pressure of the solvent vapor of below the saturation vapor pressure, prior to introducing the mixed flow in the printing region.

According to an embodiment of the present invention, an inkjet marking module comprises: an inkjet marking device being adapted to jet droplets of an inkjet marking material to form an image on a recording substrate; an evaporation device arranged for evaporating a solvent to a gaseous medium, the evaporation device comprising an aerosol generator for creating an aerosol, being a colloidal dispersion of liquid droplets of the solvent in the gaseous medium; the evaporation device comprising a droplet eliminator for removing an excess of the liquid droplets of the solvent from the aerosol, the droplet eliminator being arranged such that in operation, the droplet eliminator is located downstream of the aerosol generator.

According to an aspect of the inkjet marking module of the present invention, the inkjet marking device comprises a nozzle region comprising at least one nozzle arranged for expelling droplets of the inkjet marking material to form the image on the recording substrate, wherein the evaporation device is arranged to provide the gaseous medium comprising solvent vapor in the nozzle region of the inkjet marking device.

According to an aspect of the inkjet marking module of the present invention, the inkjet marking module further comprises a flow device configured to create a flow of the gaseous medium through the evaporation device.

According to an aspect of the inkjet marking module of the present invention, the inkjet marking module further comprises a transporting mechanism configured to transport a sheet of a recording substrate, the transporting mechanism having an outer surface, wherein the flow device is a suction mechanism arranged to provide an underpressure force at an outer surface of the transporting mechanism.

According to an aspect of the inkjet marking module of the present invention, the droplet eliminator is a passive droplet eliminator which comprises a mesh arranged for removing droplets from the aerosol.

According to an aspect of the inkjet marking module of the present invention, the droplet eliminator is an active droplet eliminator.

According to an aspect of the inkjet marking module of the present invention, the active droplet eliminator comprises a rotatable element, wherein, in operation, the rotatable element is rotated for removing the remainder of the liquid droplets from the aerosol.

According to an aspect of the inkjet marking module of the present invention, the rotatable element is a fan, the fan also being arranged for advancing the aerosol through the evaporation device.

According to an aspect of the inkjet marking module of the present invention, the evaporation device comprises an evaporation chamber arranged downstream of the aerosol generator and upstream of the droplet eliminator.

According to an aspect of the inkjet marking module of the present invention, the evaporation device comprises a temperature sensor and a heat exchanger both operatively connected with a temperature controller.

According to an aspect of the inkjet marking module of the present invention, the evaporation device additionally comprises: a first mass flow controller arranged to control a first mass flow of the gaseous medium substantially saturated with the solvent vapor; a second mass flow controller arranged to control a second mass flow of the gaseous medium having a vapor pressure of the solvent vapor of below the saturation vapor pressure; and a duct arranged downstream of the first mass flow controller and the second mass flow controller and arranged for mixing the first mass flow with the second mass flow.

It should be noted that each of the above-mentioned aspects of the inkjet marking module of the present invention can be used together or separately in the inkjet marking module of the present invention.

According to an embodiment of the present invention, a printing system comprises the inkjet marking module of the present invention, including each of the above-mentioned aspects of the marking module of the present invention.

According to an aspect of the printing system of the present invention, the printing system further comprises a fixing and drying unit, wherein solvent enriched gaseous medium generated in the fixing and drying unit is transferred to the inkjet marking module.

According to an embodiment of the present invention, a method for controlling the relative degree of saturation of a solvent vapor in a gaseous medium in the inkjet marking module of the present invention comprises the steps of: creating an aerosol of the solvent in liquid form in the gaseous medium; equilibrating the aerosol such that the gaseous medium saturates with solvent vapor; and removing solvent droplets from the aerosol.

According to an aspect of the method of the present invention, the method comprises the additional step of introducing a first flow of the gaseous medium substantially saturated with the solvent vapor in a printing region.

According to an aspect of the method of the present invention, the method comprises the additional step of mixing the first flow of the gaseous medium substantially saturated with the solvent vapor with a second flow of the gaseous medium having a vapor pressure of the solvent vapor of below the saturation vapor pressure, prior to introducing the mixed flow in the printing region.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIGS. 2A-2C are a schematic representations of an inkjet marking device, wherein FIGS. 2A and 2B illustrate an assembly of inkjet heads and FIG. 2C is a detailed view of a part of the assembly of inkjet heads;

DETAILED DESCRIPTION OF THE PREFERRED EMBODIMENTS

Figure 1:
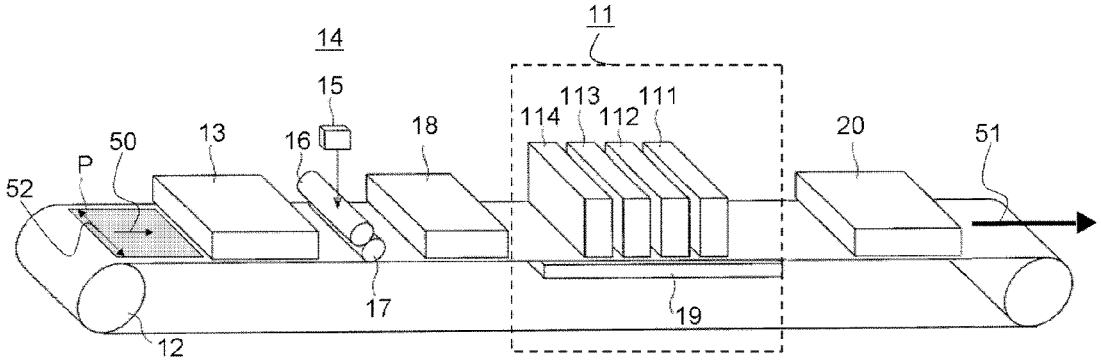
FIG. 1 is a schematic representation of an inkjet printing system.

The present invention will now be described with reference to the accompanying drawings wherein the same or similar elements have been identified with the same reference numerals.

Printing Process

A printing process in which the inks according to the present invention may be suitably used is described with reference to the appended drawings shown in FIG. 1 and FIGS. 2A-2C. FIGS. 1 and 2A-C are schematic representations of an inkjet printing system and an inkjet marking device, respectively.

FIG. 1 shows that a sheet of a receiving medium, in particular a machine coated medium P, is transported in a direction for conveyance as indicated by arrows 50 and 51 and with the aid of transportation mechanism 12. Transportation mechanism 12 may be a driven belt system comprising one (as shown in FIG. 1) or more belts. Alternatively, one or more of these belts may be exchanged for one or more drums. A transportation mechanism may be suitably configured depending on the requirements (e.g. sheet registration accuracy) of the sheet transportation in each step of the printing process and may hence comprise one or more driven belts and/or one or more drums. For a proper conveyance of the sheets of receiving medium, the sheets need to be fixed to the transportation mechanism. The way of fixation is not particularly limited and may be selected from electrostatic fixation, mechanical fixation (e.g. clamping) and vacuum fixation. Of these ways of fixing, vacuum fixation is preferred.

The printing process as described below comprises of the following steps: media pre-treatment, image formation, drying and fixing and optionally post treatment.

Media Pre-Treatment

To improve the spreading and pinning (i.e. fixation of pigments and water-dispersed polymer particles) of the ink on the receiving medium, in particular on slow absorbing media, such as machine coated media, the receiving medium may be pretreated, i.e. treated prior to printing an image on the medium. The pre-treatment step may comprise one or more of the following:

preheating of the receiving medium to enhance spreading of the used ink on the receiving medium and/or to enhance absorption of the used ink into the receiving medium;

primer pre-treatment for increasing the surface tension of receiving medium in order to improve the wettability of the receiving medium by the used ink and to control the stability of the dispersed solid fraction of the ink composition (i.e. pigments and dispersed polymer particles). Primer pre-treatment may be performed in the gas phase, e.g. with gaseous acids such as hydrochloric acid, sulfuric acid, acetic acid, phosphoric acid and lactic acid, or in the liquid phase by coating the receiving medium with a pre-treatment liquid. The pre-treatment liquid may comprise water as a solvent, one or more cosolvents, additives such as surfactants and at least one compound selected from a polyvalent metal salt, an acid and a cationic resin; and corona or plasma treatment.

Primer Pre-Treatment

As an application way of the pre-treatment liquid, any conventionally known methods can be used. Specific examples of an application way include: a roller coating, an ink-jet application, a curtain coating and a spray coating. There is no specific restriction in the number of times with which the pre-treatment liquid is applied. It may be applied at one time, or it may be applied in two times or more. Application in two times or more may be preferable, since cockling of the coated printing paper can be prevented and the film formed by the surface pre-treatment liquid will produce a uniform dry surface having no wrinkles by applying in 2 steps or more.

Especially a roller coating (see 14 in FIG. 1) method is preferable because this coating method does not need to take into consideration ejection properties and it can apply the pre-treatment liquid homogeneously to a recording medium. In addition, the amount of the applied pre-treatment liquid with a roller or with other means to a recording medium can be suitably adjusted by controlling: the physical properties of the pre-treatment liquid; and the contact pressure of a roller in a roller coater to the recording medium and the rotational speed of a roller in a roller coater which is used for a coater of the pre-treatment liquid. As an application area of the pre-treatment liquid, it may be possible to apply only to the printed portion, or to the entire surface of both the printed portion and the non-printed portion. However, when the pre-treatment liquid is applied only to the printed portion, unevenness may occur between the application area and a non-application area caused by swelling of cellulose contained in the coated printing paper with the water in the pre-treatment liquid followed by drying. Then, from the viewpoint of drying uniformly, it is preferable to apply a pre-treatment liquid to the entire surface of a coated printing paper, and roller coating can be preferably used as a coating method to the whole surface. The pre-treatment liquid may be an aqueous pre-treatment liquid.

Corona or Plasma Treatment

Corona or plasma treatment may be used as a pre-treatment step by exposing a sheet of a receiving medium to corona discharge or plasma treatment. In particular, when used on media like polyethylene (PE) films, polypropylene (PP) films, polyetyleneterephtalate (PET) films and machine coated media, the adhesion and spreading of the ink can be improved by increasing the surface energy of the media. With machine coated media, the absorption of water can be promoted which may induce faster fixation of the image and less puddling on the receiving medium. Surface properties of the receiving medium may be tuned by using different gases or gas mixtures as medium in the corona or plasma treatment. Examples are air, oxygen, nitrogen, carbon dioxide, methane, fluorine gas, argon, neon and mixtures thereof. Corona treatment in air is most preferred.

FIG. 1 shows that the sheet of receiving medium P may be conveyed to and passed through a first pre-treatment module 13, which module may comprise a preheater, for example a radiation heater, a corona/plasma treatment unit, a gaseous acid treatment unit or a combination of any of the above. Optionally and subsequently, a predetermined quantity of the pre-treatment liquid is applied on the surface of the receiving medium P at pre-treatment liquid applying member 14. Specifically, the pre-treatment liquid is provided from storage tank 15 of the pre-treatment liquid to the pre-treatment liquid applying member 14 composed of double rolls 16 and 17. Each surface of the double rolls may be covered with a porous resin material such as sponge. After providing the pre-treatment liquid to auxiliary roll 16 first, the pre-treatment liquid is transferred to main roll 17, and a predetermined quantity is applied on the surface of the receiving medium P. Subsequently, the coated printing paper P on which the pre-treatment liquid was supplied may optionally be heated and dried by drying member 18, which is composed of a drying heater installed at the downstream position of the pre-treatment liquid applying member 14 in order to decrease the quantity of the water content in the pre-treatment liquid to a predetermined range. It is preferable to decrease the water content in an amount of 1.0 weight % to 30 weight % based on the total water content in the provided pre-treatment liquid provided on the receiving medium P.

To prevent the transportation mechanism 12 being contaminated with pre-treatment liquid, a cleaning unit (not shown) may be installed and/or the transportation mechanism may comprise multiple belts or drums as described above. The latter measure prevents contamination of the upstream parts of the transportation mechanism, in particular of the transportation mechanism in the printing region.

Image Formation

Image formation is performed in such a manner that, employing an inkjet printer loaded with inkjet inks, ink droplets are ejected from the inkjet heads based on the digital signals onto a print medium.

Although both single pass inkjet printing and multi pass (i.e. scanning) inkjet printing may be used for image formation, single pass inkjet printing is preferably used since it is effective to perform high-speed printing. Single pass inkjet printing is an inkjet recording method with which ink droplets are deposited onto the receiving medium to form all pixels of the image by a single passage of a receiving medium underneath an inkjet marking module.

In FIG. 1, 11 represents an inkjet marking module comprising four inkjet marking devices, indicated with 111, 112, 113 and 114, each arranged to eject an ink of a different color (e.g. Cyan, Magenta, Yellow and blacK). The nozzle pitch of each head is, e.g. about 360 dpi. In the present invention, "dpi" indicates a dot number per 2.54 cm.

Figure 2A:
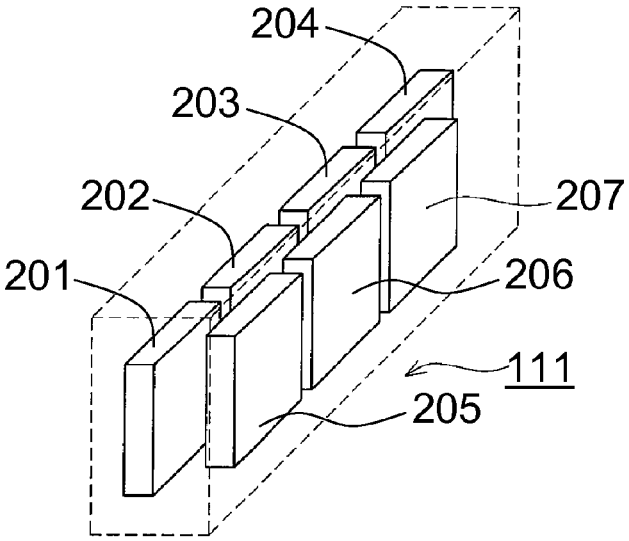
Figure 2B:
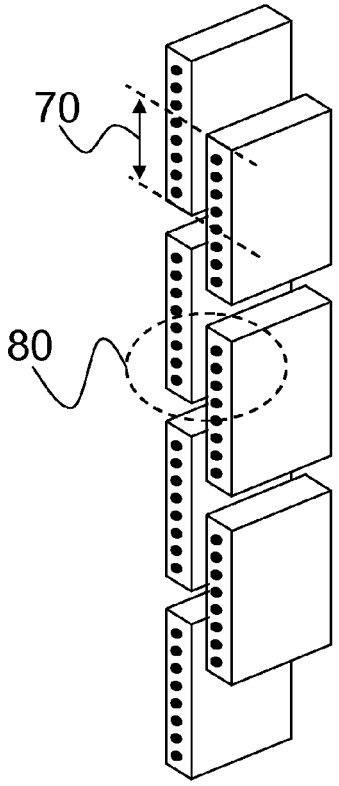
Figure 2C:
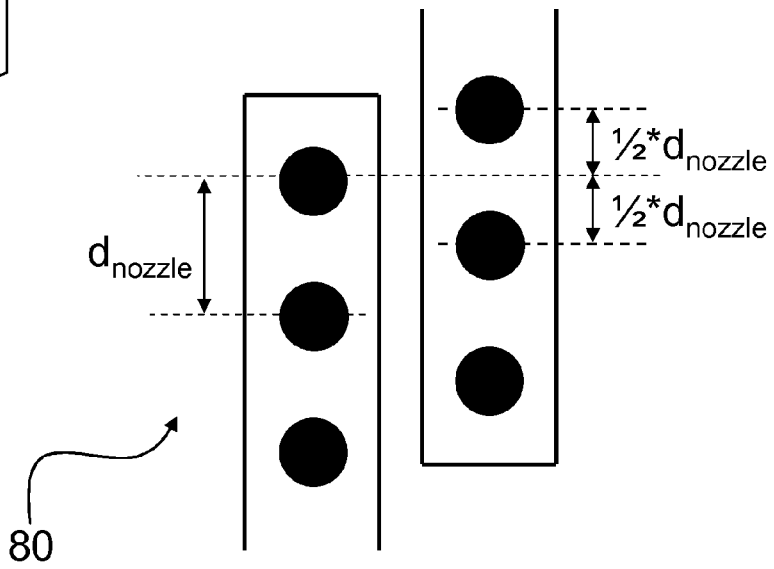

An inkjet marking device for use in single pass inkjet printing, 111, 112, 113, 114, has a length, L, of at least the width of the desired printing range, indicated with double arrow 52, the printing range being perpendicular to the media transport direction, indicated with arrows 50 and 51. The inkjet marking device may comprise a single printhead having a length of at least the width of said desired printing range. The inkjet marking device may also be constructed by combining two or more inkjet heads, such that the combined lengths of the individual inkjet heads cover the entire width of the printing range. Such a constructed inkjet marking device is also termed a page wide array (PWA) of printheads. FIG. 2A shows an inkjet marking device 111 (112, 113, 114 may be identical) comprising 7 individual inkjet heads (201, 202, 203, 204, 205, 206, 207), which are arranged in two parallel rows, a first row comprising four inkjet heads (201-204) and a second row comprising three inkjet heads (205-207), which are arranged in a staggered configuration with respect to the inkjet heads of the first row. The staggered arrangement provides a page wide array of nozzles, which are substantially equidistant in the length direction of the inkjet marking device. The staggered configuration may also provide a redundancy of nozzles in the area where the inkjet heads of the first row and the second row overlap, see 70 in FIG. 2B. Staggering may further be used to decrease the nozzle pitch (hence increasing the print resolution) in the length direction of the inkjet marking device, e.g. by arranging the second row of inkjet heads such that the positions of the nozzles of the inkjet heads of the second row are shifted in the length direction of the inkjet marking device by half the nozzle pitch, the nozzle pitch being the distance between adjacent nozzles in an inkjet head, $d_{nozzle}$(see FIG. 2C, which represents a detailed view of 80 in FIG. 2B). The resolution may be further increased by using more rows of inkjet heads, each of which are arranged such that the positions of the nozzles of each row are shifted in the length direction with respect to the positions of the nozzles of all other rows.

In image formation by ejecting an ink, an inkjet head (i.e. printhead) employed may be either an on-demand type or a continuous type inkjet head. As an ink ejection system, there may be usable either the electric-mechanical conversion system (e.g., a single-cavity type, a double-cavity type, a bender type, a piston type, a shear mode type, or a shared wall type), or an electric-thermal conversion system (e.g., a thermal inkjet type, or a Bubble Jet type (registered trade name)). Among them, it is preferable to use a piezo type inkjet recording head, which has nozzles of a diameter of 30 μm or less in the current image forming method.

FIG. 1 shows that after pre-treatment, the receiving medium P is conveyed to an upstream part of the inkjet marking module 11. Then, image formation is carried out by each color ink ejecting from each inkjet marking device 111, 112, 113 and 114 arranged so that the whole width of the receiving medium P is covered.

Optionally, the image formation may be carried out while the receiving medium is temperature controlled. For this purpose a temperature control device 19 may be arranged to control the temperature of the surface of the transportation mechanism (e.g. belt or drum) underneath the inkjet marking module 11. The temperature control device 19 may be used to control the surface temperature of the receiving medium P, for example in the range of 30° C. to 60° C. The temperature control device 19 may comprise heaters, such as radiation heaters, and a cooling device, for example a cold blast, in order to control the surface temperature of the receiving medium within said range. Subsequently and while printing, the receiving medium P is conveyed to the downstream part of the inkjet marking module 11.

Figure 3:
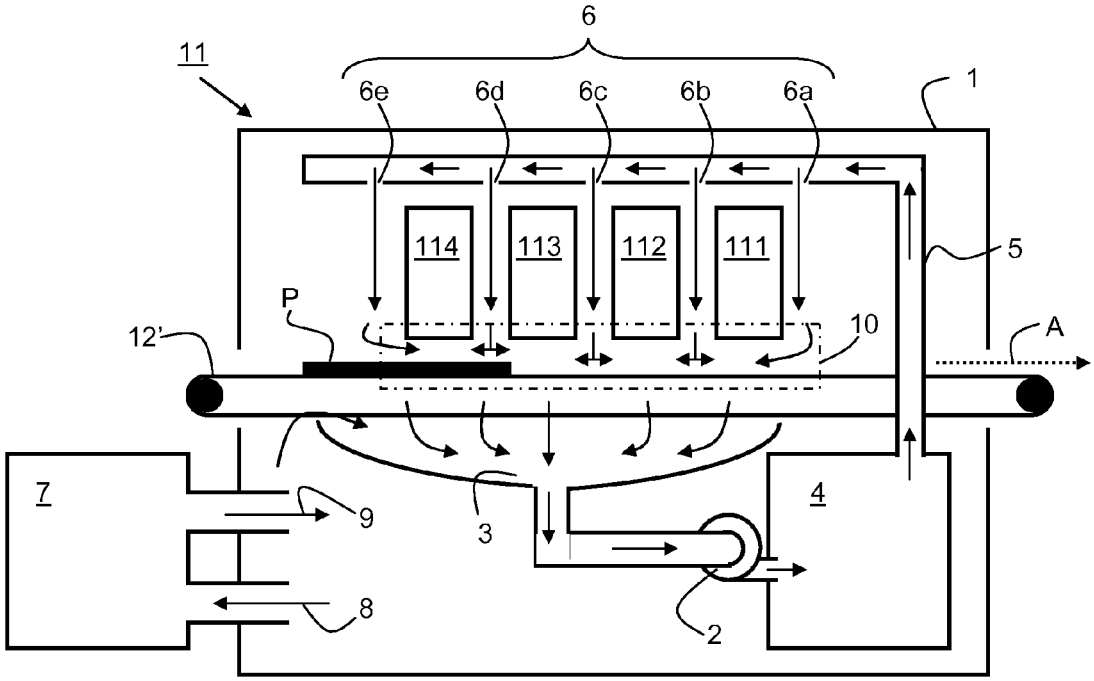
FIG. 3 is a schematic representation of an inkjet marking module comprising an evaporation device according to an embodiment of the present invention.

FIG. 3 shows an inkjet marking module 11 comprising an evaporation device 4 arranged for providing a microclimate of a high relative humidity in a printing region 10. The evaporation device 4 has an inlet in fluid connection with a feed fan 2 and an outlet in fluid connection with duct 5. Duct 5 comprises a number of holes 6*a*, 6*b*, 6*c*, 6*d* and 6*e*, the holes being located such that, in operation, a flow of air that is saturated or nearly saturated with water (i.e. air with a relative humidity (RH) of 100% or just below) is created along and between the inkjet marking devices 111, 112, 113 and 114, such that highly humid conditions are obtained and maintained in the printing region 10. Airflows are indicated with solid arrows in FIG. 3.

In an embodiment, holes 6*a*, 6*b*, 6*c*, 6*d*, and 6*e* may be in fluid connection with ducts (not shown), which extend from said holes downward and end in the printing region 10, in particular in the vicinity of the nozzles of the inkjet heads present in the inkjet marking modules 111, 112, 113 and 114. This embodiment enables precisely supplying a highly humid air flow to the surroundings of the nozzles of the inkjet heads.

FIG. 3 further shows that the inkjet marking module 11 is provided with a suction box 3 which is in fluid connection with the input side of feed fan 2. The suction box 3 is arranged to provide an underpressure force at an outer surface of the transporting mechanism 12'. The transporting mechanism is arranged for advancing a sheet of receiving medium P through the printing region 10 and underneath the inkjet marking devices 111, 112, 113 and 114 in the direction of dotted arrow A. Air present in the interior of the housing 1 of the inkjet marking module, which is a substantially closed space, is sucked into the suction box 3 and fed to the evaporation device 4 via feed fan 2. In order to prevent deformation of the sheet of a recording substrate P during printing an image thereon in the printing region 10, relatively large underpressure forces are induced to hold down the medium. Consequently the suction flow through the suction box is in the order of between 100 $m^2$/hr and 200 $m^2$/hr. In the present example the suction flow is fed to the evaporation device 4.

The operation of the evaporation device 4 will be further discussed below with reference to FIGS. 4A and 4B.

The inkjet marking module 11 shown in FIG. 3 further comprises an air conditioning device 7, arranged for conditioning the bulk air present in the inkjet marking module 11. In the context of the present invention, the bulk air is to be construed as the total volume of air present in the inkjet marking module 11. The relative humidity (RH) of the bulk air is controlled between 40% and 90%, preferably between 50% and 85%, more preferably between 60% and 80% at the operating temperature of the inkjet marking module 11, which is preferably below the jetting temperature and above the temperature of the flow of water saturated air leaving evaporation device 4. The air flow of air substantially saturated with water vapor which is introduced in the printing region 10, quickly mixes with bulk air, which has a controlled relative humidity of below 100% as described above. Therefore, the relative humidity of said mixture is below 100% and consequently condensation of water in the inkjet marking module 11, in particular on the inkjet marking devices 111, 112, 113 and 114, more particularly in the vicinity of the nozzles of the inkjet heads, is prevented in this way. The jetting temperature may be controlled by heating the inkjet marking devices, in particular the individual inkjet heads, which comprise a heater for this purpose, in particular an electrical resistive heater. To prevent overshoot of the jetting temperature, the inkjet marking devices 111, 112, 113 and 114 may be additionally cooled.

The air conditioning device 7 may comprise a device for heating and/or cooling the entering air flow (indicated with arrow 8) and/or a device for controlling the humidity of the entering air flow. The device for heating and/or cooling may be a heat exchanger; a heater, in particular an electrical heater; and/or a cooler, in particular a cooling fan (air cooling) or a heat exchanger with a cooling liquid. The device for controlling the humidity may comprise a condenser and/or an evaporator.

Due to the fact that the suction flow through the suction box 3 may be between 100 $m^2$/hr and 200 $m^2$/hr, which is fed to the evaporation device 4 and then reintroduced in the printing region 10, the relative humidity in the interior of the housing of the inkjet marking module (see 1 in FIG. 3) may rise. Therefore, in an embodiment, the volume flow rate through the evaporation device 4 ($F_4$ [$m^3$/s]) and the volume flow rate through the air conditioning device 7 ($F_7$ [$m^3$/s]) are tuned with respect to each other in order to control the temperature and humidity of the bulk air present in the inkjet marking module 11, and to provide highly humid air in the vicinity of the nozzles of the inkjet marking devices 111, 112, 113, 114. The relatively large suction flow, which is humidified and reintroduced in the printing region 10, provides and maintains a highly humid air boundary layer near the nozzles of the inkjet marking devices and hence prevents or at least mitigates drying of ink in the nozzle region, in particular in the nozzles. Because of the relatively large suction flow which has to be humidified in the evaporation device 4, a certain level of RH of the bulk air present in the inkjet marking module is required in order to be able to reach saturation during the relatively short residence time of the air in the evaporation device 4.

For example if the interior of the housing of the inkjet marking module has a volume of 1 $m^3$ and the suction flow is 100 $m^3$/hr, the entire volume of said interior is refreshed every 36 seconds. If the relative humidity of the bulk is kept at 70% (at e.g. 23° C.) by the air conditioning device 7, the evaporation device 4 needs to be able to evaporate about 600 grams of water per hour to obtain an air flow in the printing region 10 of air substantially saturated with water vapor. On the other hand, despite some leaking of (moist) air from the inkjet marking module 11, which in practice is not an entirely closed space, a similar amount of water needs to be removed from the bulk air by the air conditioning device 7.

Figure 4A:
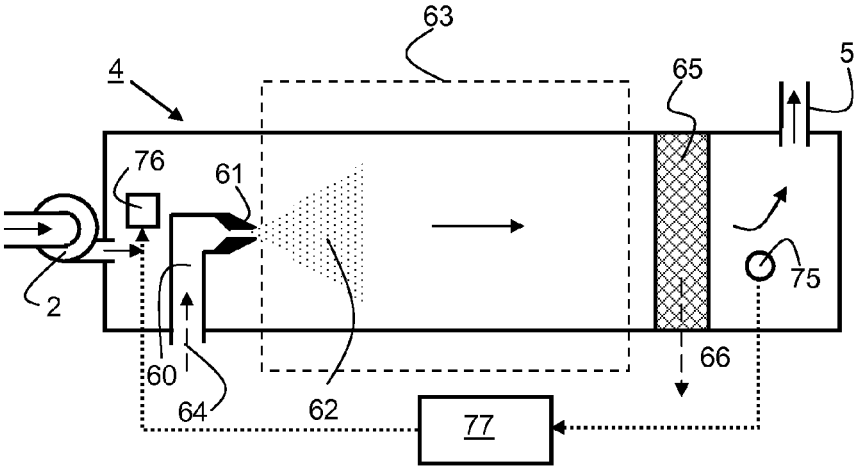
FIG. 4A is a schematic representation of an evaporation device according to an embodiment of the present invention.

In an embodiment, as shown in FIG. 4A, the evaporation device 4 comprises an inlet, which is in fluid connection with the suction box (not shown) via feed fan 2 and an outlet, which is in fluid connection with duct 5 (see also FIG. 1). The evaporation device 4 comprises a spray humidifier 60 having a nozzle 61 through which pressurized water is fed, such that an aerosol 62 comprising water droplets (dispersed phase), or in other words a mist, is generated. In order to provide enough residence time for the water droplets to evaporate and to saturate the air (which is the continuous phase of the aerosol), the conditioning device comprises an evaporation chamber 63. Alternatively, the evaporation chamber may be absent and instead a duct (not shown), being long enough to provide said residence time, is provided. Combinations of one or more ducts with one or more evaporation chambers are also possible. Depending on the desired maximum volume flow rate [$m^3$/s] and the necessary residence time [s] for the air flow to reach saturation with water, the required volume of the evaporation chamber 63 (or alternatively an evaporation duct or the above mentioned combination) can be calculated. The evaporation device 4 shown in FIG. 4A comprises a passive droplet eliminator 65, arranged downstream of the spray humidifier 60. In the context of the present invention, the passive droplet eliminator 65, is to be construed as a droplet eliminator that does not contain moving parts arranged for removing water droplets from the aerosol. In particular, the passive droplet eliminator comprises a mesh, which acts as a sieve and removes the water droplets from the aerosol. The mesh may, for example comprise one or more layers of a nylon mesh having square holes with a dimension of between 1 mm and 6 mm, preferably between 3 mm and 5 mm. The evaporation of water requires heat, which is absorbed from the continuous phase (air) of the aerosol. The aerosol may drop in temperature. Therefore, the temperature in the evaporation chamber 63, or an equivalent evaporation device, may need to be controlled. For this purpose a temperature sensor 75 is arranged downstream of the passive droplet eliminator 65 and a heat exchanger 76 (e.g. heater and/or cooling device) is arranged upstream of the spray humidifier, the temperature sensor 75 and the heat exchanger being operatively connected to a controller 77. In alternative embodiments, the locations of both the temperature sensor 75 and the heat exchanger 75 may differ from the present example. However, the locations of both as described in the present example provide accurate temperature control, because both the measurement and the heat exchange are not performed in the aerosol.

Water saturated air leaves the evaporation device through duct 5, ready to be supplied to the inkjet marking devices 111, 112, 113 and 114 (see FIG. 3). The excess water is collected and removed from the droplet eliminator as indicated with interrupted arrow 66. Optionally, the excess water is recycled to the spray humidifier, or to the evaporator of the air conditioning device 7.

The air flow leaving the evaporation device 4 is saturated or substantially saturated, or in other words the air flow leaving the evaporation device has a RH of 100% or just below.

Therefore, continuous and accurate control of the relative humidity in a printing region at a high relative humidity level while preventing super saturation and condensation is enabled by the method and device as described above.

Figure 4B:
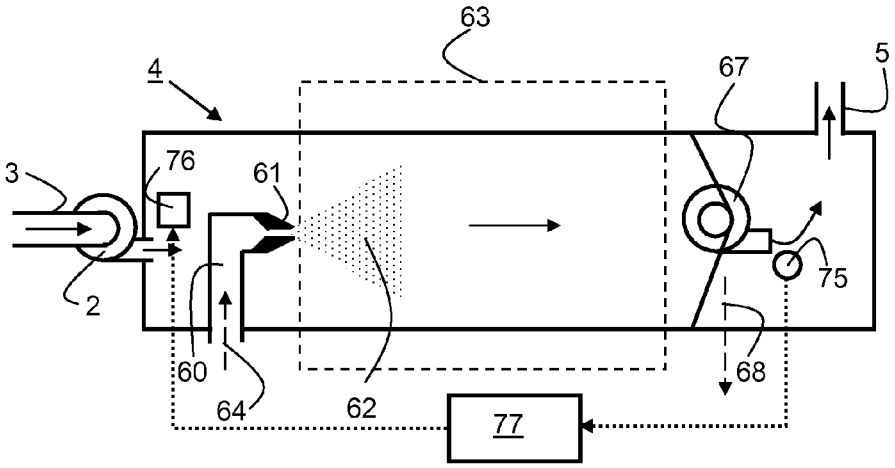
FIG. 4B is a schematic representation of an evaporation device according to an embodiment of the present invention.

The evaporation device 4 shown in FIG. 4B differs from the embodiment shown in FIG. 4A in that instead of the passive droplet eliminator 65, the evaporation device 4 comprises an active droplet eliminator 67, arranged downstream of the spray humidifier 60. All other numbers refer to identical parts as shown in FIG. 4A and described above. In the context of the present invention, the active droplet eliminator 67 is to be construed as a droplet eliminator comprising a moving part, the moving part having a function of removing droplets (and/or solid particles) from the aerosol. The moving part may be a rotating disk, the rotating disk being arranged such that its normal is substantially in parallel with the flow direction of the aerosol. When the air flow hits the disk, particulate matter, in particular water droplets can be removed from the air flow by centrifugal forces.

In an embodiment, the active droplet eliminator 67 may be a centrifugal fan, as is shown in FIG. 4B. In this embodiment, water droplets are also removed from the aerosol by centrifugal forces. It is an advantage of this embodiment that a centrifugal fan is also able to advance the aerosol through the evaporation device 4 and hence create an air flow. Therefore, in this embodiment, the feed fan 2 becomes optional.

Figure 4C:
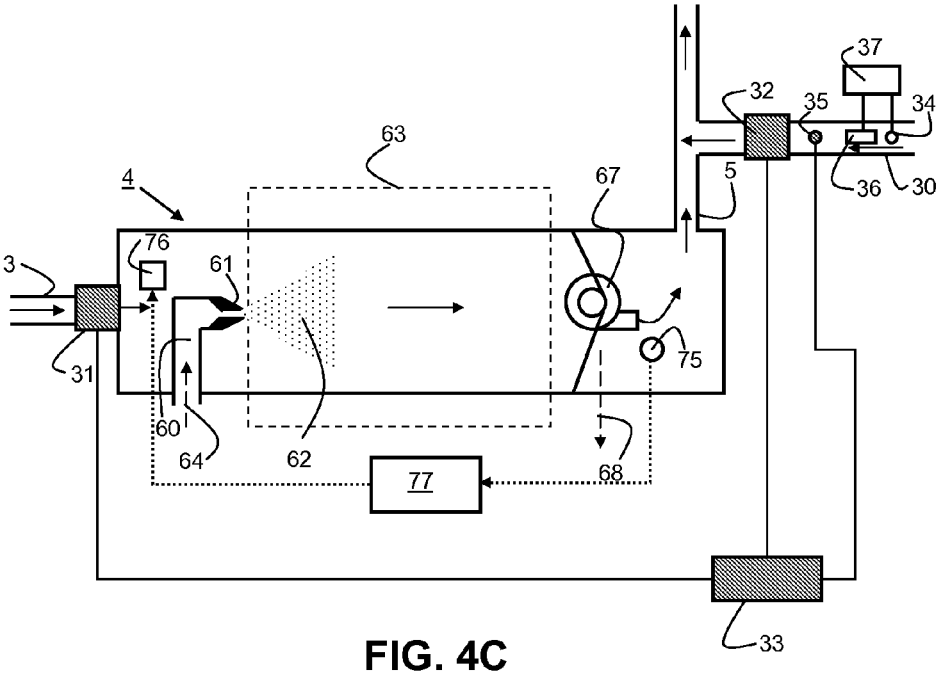
FIG. 4C is a schematic representation of an evaporation device according to an embodiment of the present invention.

In an embodiment, it may be desirable to provide an air flow having a RH below 100%, for example between 70% and 98%, or in particular between 75% and 95%, or between 80% and 93%, in particular in the vicinity of the nozzles as described above. In order to control the RH within a predetermined range, the evaporation device 4 as shown in FIGS. 4A and 4B may be adapted in the way described below and as shown in FIG. 4C.

In this embodiment, the evaporation device 4 comprises a duct 30, a first mass flow controller 31 (MFC) and a second mass flow controller 32. The first mass flow controller 31 is preferably arranged between the suction box 3 and the evaporation device 4 to control a first flow, which is the feed flow to the evaporation device 4. The second MFC 32 is arranged in fluid connection with duct 30 to control a second air flow. The second air flow may originate from the bulk of the inkjet marking module 11 or from the environment. Duct 30 extends from the second MFC 32 to the interior of the housing of the inkjet marking module (see 1 in FIG. 3) or to its surroundings, depending on the desired origin of the air flow as described above. In the latter configuration, the inkjet marking module 11 may be provided with an exhaust duct (not shown), to prevent an increase in pressure inside the inkjet marking module 11. The discharge from the exhaust duct may be controlled by a valve.

Both the first mass flow controller 31 and the second mass flow controller 32 are operatively connected to a mass-flow-ratio controller 33.

The first air flow will be (substantially) saturated with water (i.e. $RH_1$=100%) when leaving the evaporation device 4 and have a predetermined and controlled temperature $T_1$. $T_1$ may also be measured, for example with a temperature sensor (not shown) in duct 5 near the exit of the evaporation device 4. The second air flow must have a lower RH than the first air flow. The temperature $T_2$ and $RH_2$ of the second air flow can be measured by a temperature sensor 34 and (relative) humidity sensor 35, respectively, arranged in for example duct 30. The second air flow may be temperature controlled. For this purpose, a heat exchanger 36 is arranged in, for example duct 30. The heat exchanger 36 and the temperature sensor 34 are operatively connected to a temperature controller 37. Based on a desired temperature and relative humidity of the mixed air flow ($T_{mix}$ and $RH_{mix}$, respectively), $T_1$, $T_2$, $RH_1$, $RH_2$, a mass balance and a heat balance, the RH control of the combined (mixed) flows reduces to a mass-flow-ratio control (i.e. control of the ratio of the first and the second air flows). The total (combined) air flow can be controlled independently of the ratio. The (relative) humidity sensor 35 is arranged for determining the ratio of the first and the second air flow while taking into account that the relative humidity of the second air flow, e.g. ambient air flow, may change in time. Such changes in the relative humidity of the second air flow will be gradual (e.g. due to changing weather conditions) relative to the time scale of (high speed) printing. Therefore such changes can be easily compensated for in said mass-flow-ratio control.

Many alternative ways of mixing two or more air flows in order to obtain a (mixed) single air flow having a controlled temperature and relative humidity are thinkable, all of which do not deviate from the concept that a temperature and humidity controlled air flow is generated by mixing at least two air flows having known temperatures and RH's. The control comprises a mere flow ratio control of the mixed flows, rather than controlling the RH by evaporation and or condensation of water. The latter is difficult, inaccurate and has a long response time. Therefore, such alternative ways are within the scope of the present embodiment, which embodiment is given as a mere example of said concept.

In an embodiment (not shown), a correlation between the saturated vapor pressure of water in air and the temperature can be used to control the RH of the air flow leaving the evaporation device 4 and entering duct 5 by a temperature control in the evaporation chamber combined with a temperature control of the air flow leaving the conditioning device.

There are several empirical correlations that can be used to estimate the saturated vapor pressure of water vapor in air as a function of temperature. The Antoine equation is among the least complex of these formulas, having only three parameters (A, B, and C). Other correlations, such as those presented by Goff-Graph and Magnus Tenet, are more complicated but yield better accuracy. Another correlation presented by Buck is commonly encountered in the literature and provides a reasonable balance between complexity and accuracy. For this embodiment, the Antoine equation is used for illustration purposes only. The Antoine equation is represented by equation 1.

$$^{10}\log p_{ast}=A-B/(C+T) \qquad \text{equation 1}$$

wherein:

$p_{ast}$ represents the saturated vapor pressure at temperature T in mmHg;

T is the temperature in degrees Celsius (° C.);

A, B and C are constants which are given in Table 1

TABLE 1

Antoine constants for a water-air system

| | In temperature range: 0° C.-100° C. | In temperature range: 99° C.-374° C. |
|---|---|---|
| A [−] | 8.07131 | 8.14019 |
| B [° C.] | 1730.63 | 1810.94 |
| C [° C.] | 233.426 | 244.485 |

The Antoine equation and the desired temperature and RH of the flow leaving the evaporation device 4 can be used to calculate the partial pressure of water vapor in said air flow. The calculated partial pressure equals the saturated vapor pressure to be obtained in the evaporation chamber 63. Thus the desired temperature in the evaporation chamber 63 can be calculated by again using the Antoine equation.

For the purpose of illustration some calculations are shown in Table 2.

For example, if the jetting temperature is 25° C. and the bulk temperature in the inkjet marking device is controlled to be 23° C., the desired temperature of the air flow leaving the evaporation device 4 is between 23° C. and 25° C., for reasons described above.

TABLE 2

Antoine calculations

| Temperature evaporation chamber | Desired temperature (° C.) of exit flow of the evaporation device | | | | | | |
|---|---|---|---|---|---|---|---|
| (° C.) | RH = 75% | RH = 80% | RH = 85% | RH = 90% | RH = 93% | RH = 95% | RH = 98% |
| 15 | 19.5 | 18.5 | 17.5 | 16.6 | 16.1 | 15.8 | 15.3 |
| 18 | 22.6 | 21.6 | 20.6 | 19.7 | 19.2 | 18.8 | 18.3 |
| 20 | 24.7 | 23.6 | 22.6 | 21.7 | 21.2 | 20.8 | 20.3 |
| 21 | 25.7 | 24.7 | 23.7 | 22.7 | 22.2 | 21.8 | 21.3 |
| 22 | 26.8 | 25.7 | 24.7 | 23.7 | 23.2 | 22.8 | 22.3 |
| 24 | 28.9 | 27.8 | 26.7 | 25.8 | 25.2 | 24.9 | 24.3 |

TABLE 2-continued

| Antoine calculations | | | | | | | |
|---|---|---|---|---|---|---|---|
| Temperature evaporation chamber | Desired temperature (° C.) of exit flow of the evaporation device | | | | | | |
| (° C.) | RH = 75% | RH = 80% | RH = 85% | RH = 90% | RH = 93% | RH = 95% | RH = 98% |
| 27 | 32 | 30.9 | 29.8 | 28.8 | 28.2 | 27.9 | 27.3 |
| 30 | 35.1 | 33.9 | 31.9 | 33.9 | 31.3 | 30.9 | 30.4 |

The desired RH is, for example selected to be 85%. Then from Table 2 it can be deduced that the temperature in the evaporation chamber 63 needs to be controlled between 20° C. and 22° C. These calculations are made under the assumption of isobaric heating, implying that the pressure in the evaporation chamber 63 and at the outlet of the evaporation device 4 are the same and constant. In this embodiment, the air conditioning device 7 may be dispensed with, because the risk of condensation has been significantly reduced.

Figure 6:
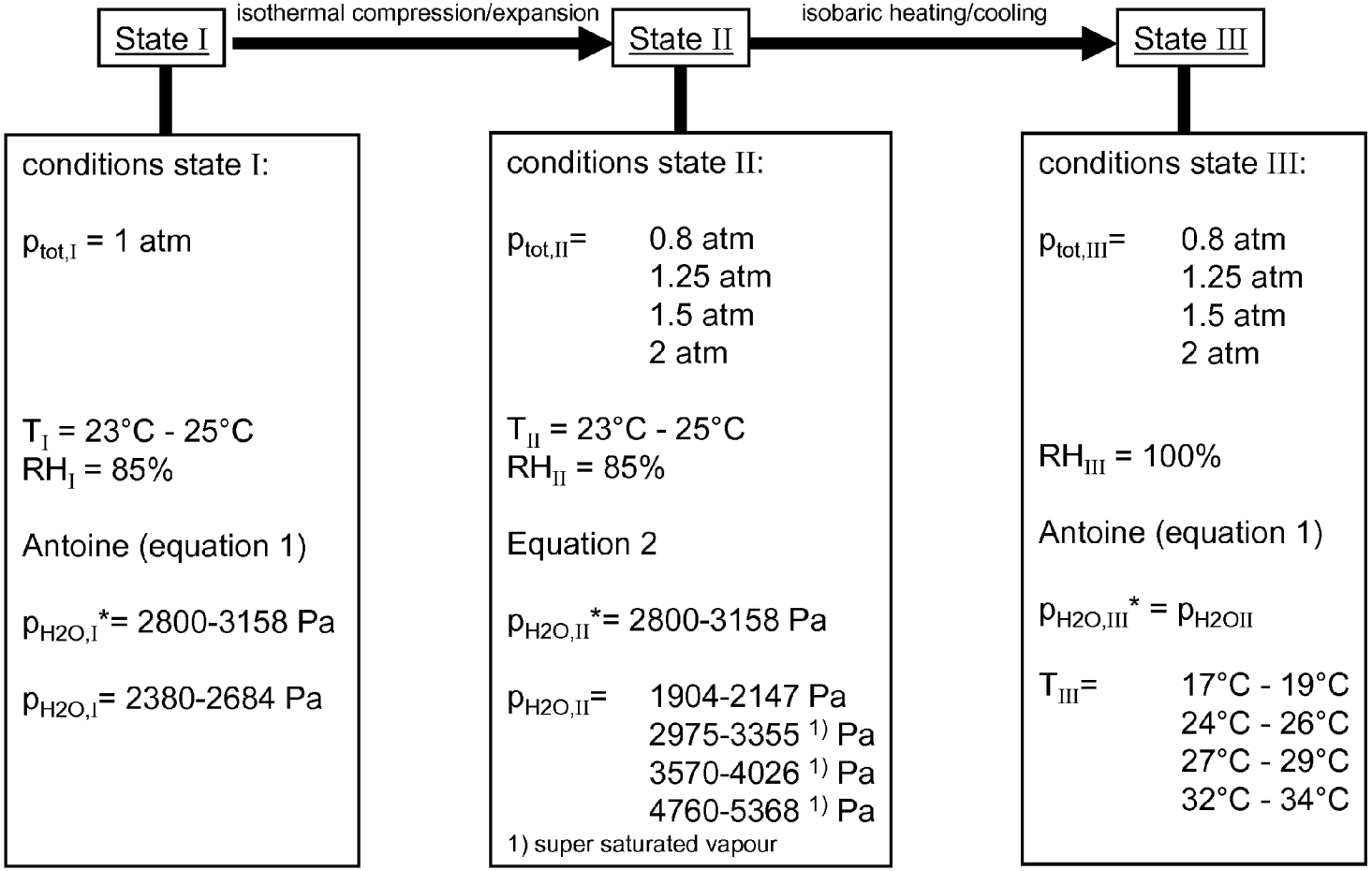
FIG. 6 is a schematic representation of a calculation of a pressure and a temperature range, which are control variables for a device for controlling air humidity according to an embodiment of the present invention.

In an embodiment, the evaporation device 4 is operated at a different pressure than the inkjet marking module 11. In such a case, the pressure at the outlet of the air conditioning device may be different from the pressure inside the evaporation device 4, in particular in the evaporation chamber 63. The temperature range in which the temperature of the evaporation chamber 63 needs to be controlled can then be calculated as schematically shown in FIG. 6. State I represents the state of moist air at the outlet of the evaporation device. In a particular example, the total pressure at the outlet (i.e. the pressure inside the inkjet marking module 11), $p_{tot,I}$, is 1 atmosphere; the desired temperature (see example above) is between 23° C. and 25° C. and the desired relative humidity ($RH_I$) is 85%. The saturated vapor pressure ($p_{H2O,I}$*) within the desired temperature range is between 2800 Pa and 3158 Pa. At a $RH_I$ of 85% the desired partial water vapor pressure ($p_{H2O,I}$) is between 2380 Pa and 2684 Pa.

State II represents a fictive state after an isothermal compression or expansion, depending on the operating pressure of the evaporation device 4 (see state C). In the present example, the evaporation device 4 is operated at 0.8, 1.25, 1.5 and 2 atm (see FIG. 6), the corresponding partial water vapor pressure range can then be calculated with equation 2.

$$p_{H2O,II}=p_{tot,II}/p_{tot,I}\times p_{H2O,I} \qquad \text{equation 2}$$

wherein:

$p_{H2O,I}$ represents the partial water vapor pressure in state I;

$p_{H2O,II}$ represents the partial water vapor pressure in state II;

$p_{tot,I}$ represents the total pressure in the evaporation device 4 in state I;

$p_{tot,II}$ represents the total pressure in the evaporation device 4 in state II.

The partial water vapor pressure range in state II ($p_{H2O,II}$) is shown in FIG. 6, for example for an operating pressure of the evaporation device 4 of 1.5 atm, the range between which $p_{H2O,II}$, lies according to equation 2 is from 3570 Pa to 4026 Pa. It is noted that in this case, the calculated partial water vapor pressure is above the saturated vapor pressure ($p_{H2O,II}$*). Therefore, State II represents a super-saturated water-air state (or condensation might occur). However, State II is a fictive state, which is only introduced for calculation purposes. State II does not actually exist in the system. By introducing state II, the calculation from state I to state III can be decomposed into an isothermal compression or expansion (from state I to state II) step and an isobaric heating or cooling step (from state II to state III). The actual step in the system is from state I to state III.

State III represents the state in the evaporation device 4, in particular in the evaporation chamber 63. In the present example, the total pressure in the evaporation chamber is 1.5 atm ($p_{tot,III}$), the relative humidity is 100% ($RH_{III}$) and the saturated vapor pressure ($p_{H2O,III}$*) is equal to partial vapor pressure calculated in state II, which is between 3570 Pa and 4026 Pa (see above). The corresponding temperature range (of $T_{III}$) can be calculated according to the Antoine equation (equation 1) and is between 27° C. and 29° C.

In conclusion, when the pressure and temperature in the evaporation chamber are controlled to be 1.5 atm and between 27° C. and 29° C. respectively, moist air of between 23° C. and 25° C., and a RH of 85% is obtained at 1 atm.

Drying and Fixing

After an image has been formed on the receiving medium, the prints have to be dried and the image has to be fixed onto the receiving medium. Drying comprises the evaporation of solvents, in particular those solvents that have poor absorption characteristics with respect to the selected receiving medium.

FIG. 1 schematically shows a drying and fixing unit 20, which may comprise a heater, for example a radiation heater. After an image has been formed, the print is conveyed to and passed through the drying and fixing unit 20. The print is heated such that solvents present in the printed image, to a large extent water, evaporate. The speed of evaporation and hence drying may be enhanced by increasing the air refresh rate in the drying and fixing unit 20. Simultaneously, film formation of the ink occurs, because the prints are heated to a temperature above the minimum film formation temperature (MFT). The residence time of the print in the drying and fixing unit 20 and the temperature at which the drying and fixing unit 20 operates are optimized, such that when the print leaves the drying and fixing unit 20, a dry and robust print has been obtained. As described above, the transportation mechanism 12 in the fixing and drying unit 20 may be separated from the transportation mechanism of the pre-treatment and printing section of the printing apparatus and may comprise a belt or a drum.

Figure 5:
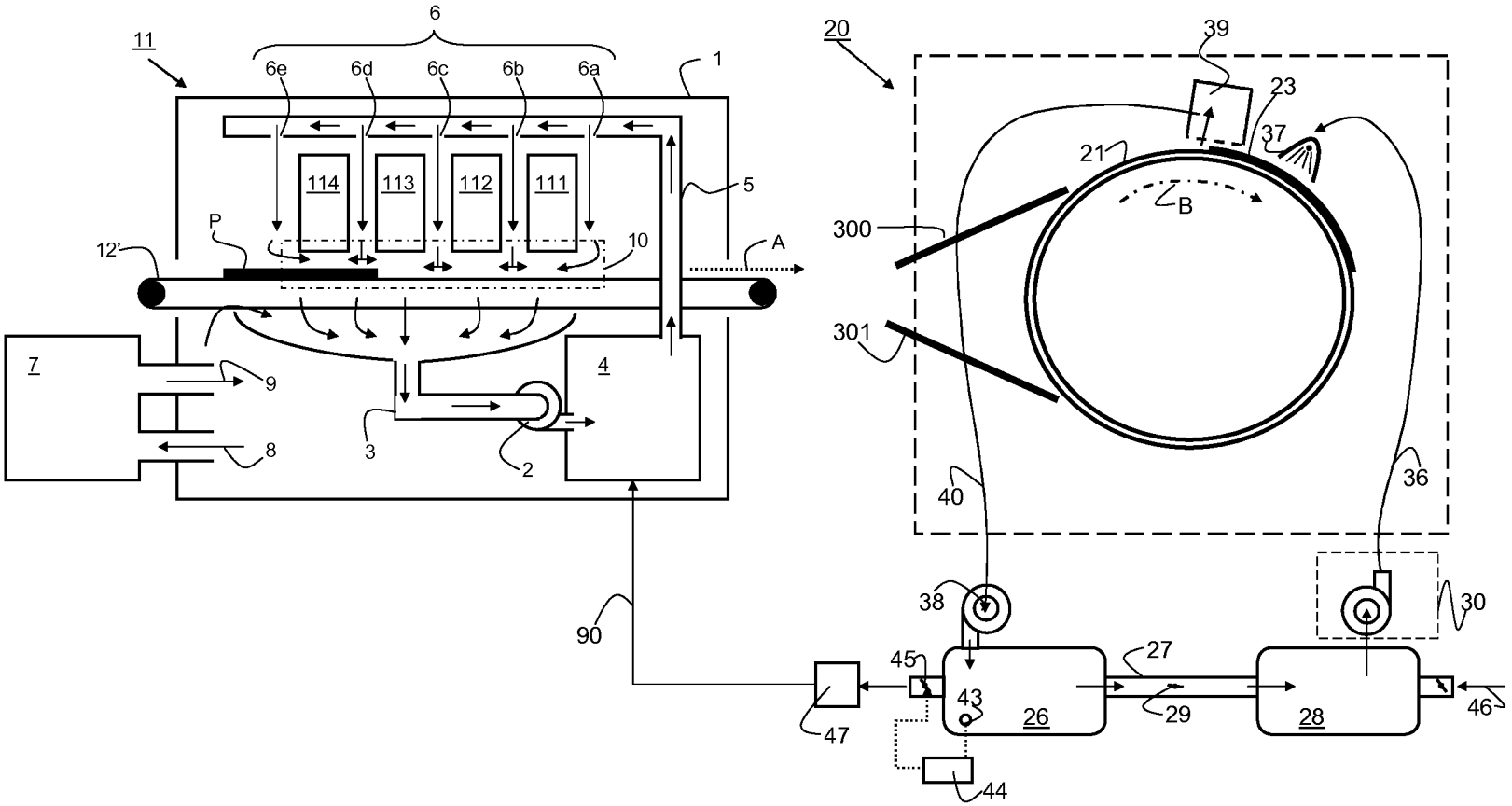
FIG. 5 is a schematic representation of an inkjet printing system comprising an inkjet marking module according to the present invention and a recording substrate treatment apparatus.

FIG. 5 shows a schematic representation of a part of the inkjet printing system as shown in FIG. 1, comprising a recording substrate treatment apparatus, being the fixing and drying unit 20 and a inkjet marking module 11 as shown in FIG. 3. In FIG. 3, 11 represents an inkjet marking module comprising four inkjet marking devices, indicated with 111, 112, 113 and 114, as described above. The inkjet marking module comprises a humidifier 4 in order to control the (relative) humidity in the marking module, to prevent drying of the marking substance in the marking devices 111, 112, 113 and 114.

FIG. 5 further shows a recording substrate treatment apparatus, being a fixing and drying unit 20. For clarity reasons, FIG. 5 does not show all ducts connecting the parts of the drying and fixing unit 20. The fluid connections and flows are indicated with solid arrows.

The fixing and drying unit 20 comprises a transporting mechanism 21, in the present embodiment a drum, which in operation rotates about its axial axis (not shown) in a direction indicated with arrow B. Alternatively, the transporting mechanism may be an endless belt. In operation, a sheet of a recording substrate enters the fixing and drying unit 20 at position 300 and leaves it at position 301. In operation, a sheet of a recording material 23 is held down on the outer surface of the transporting mechanism 21, for example by an underpressure force, and transported in the direction indicated with arrow B.

The fixing and drying unit 20 further comprises a suction mechanism 38, comprising an inlet that is in fluid connection with an air removal device 39, as indicated with arrow 40. The suction mechanism 38 comprises an outlet that is in fluid connection with an in-box 26. The air removal device 39 is arranged opposite the outer surface of the transporting mechanism 21 and in operation removes air from the surroundings of the transporting mechanism 21, in particular from the vicinity of the outer surface of the transporting mechanism 21.

The in-box 26 is in fluid connection with an out-box 28 via a duct 27 comprising a valve 29, e.g. a butterfly valve. The out-box is in fluid connection with a blowing mechanism 30, in this particular example comprising a blowing fan. The blowing mechanism 30 is arranged to provide an air flow to the heating device, in this particular example a radiation heating device 37 (e.g. CIR), as is indicated with arrow 36. The radiation heating device 37 is arranged to heat the outer surface of the transporting mechanism 21, in particular to heat a passing sheet of a recording substrate 23. The radiation heating mechanism 37 may be cooled by an air flow generated by the blowing mechanism 30.

The fixing and drying unit 20 of the present example further comprises a humidity sensor 43, in particular a relative humidity sensor. The humidity sensor 43 is operatively connected to a second flow controller 44, which is operatively connected to a controllable valve 45, in particular a controllable butterfly valve. Alternatively, the (relative) humidity sensor may be suitably located in the inlet or outlet of the suction mechanism 38, or the sensor may be located in the out-box 28. In any case, depending on the (relative) humidity of the air circulating in the fixing and drying unit 20, the flow controller determines a discharge portion required to maintain the (relative) humidity of the circulating air within a predetermined range, e.g. between 20% and 60%, and controls the controllable valve 45 accordingly. Fresh make-up air may then be supplied to the out-box 28 for compensating for the discharged air, as is indicated with arrow 46.

Optionally, the discharged air may be purified by a purifier 47. The purifier may, for example be arranged to remove solid and liquid contaminants from the discharged air flow, e.g. dust, grease particles, marking substance residues, etc.

To increase the efficiency of the humidifier 4, the humidifier 4 receives the purified discharge air from the fixing and drying module 20, as indicated with arrow 90. The discharge air usually has a higher (relative) humidity than the air in the surroundings of the printing device (ambient air). Therefore, the humidifier requires less energy to evaporate water to control the (relative) humidity of the air present in the inkjet marking module 11. Alternatively, the (moist) discharge air of the fixing and drying unit 20 may be introduced in the bulk air present in the inkjet marking module 11, or the (moist) discharge air may be suitably used anywhere else in the printing system where an elevated (relative) humidity is required. Depending on the application, the moist discharge air of the fixing and drying unit 20 may be cooled or heated, prior to use in the printing system.

Hitherto, the printing process was described such that the image formation step was performed in-line with the pre-treatment step (e.g. application of an (aqueous) pre-treatment liquid) and a drying and fixing step, all performed by the same apparatus (see FIG. 1). However, the printing process is not restricted to the above-mentioned embodiment. A method in which two or more machines are connected through a belt conveyor, drum conveyor or a roller, and the step of applying a pre-treatment liquid, the (optional) step of drying a coating solution, the step of ejecting an inkjet ink to form an image and the step or drying an fixing the printed image are performed. It is, however, preferable to carry out image formation with the above defined in-line image forming method.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually and appropriately detailed structure. In particular, features presented and described in separate dependent claims may be applied in combination and any combination of such claims are herewith disclosed.

Further, the terms and phrases used herein are not intended to be limiting; but rather, to provide an understandable description of the invention. The terms "a" or "an", as used herein, are defined as one or more than one. The term another, as used herein, is defined as at least a second or more. The term having, as used herein, are defined as comprising (i.e., open language).

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An inkjet marking module, comprising:

an inkjet marking device, said inkjet marking device being adapted to jet droplets of an inkjet marking material to form an image on a recording substrate;

an evaporation device arranged for evaporating a solvent to a gaseous medium, the evaporation device comprising:

an aerosol generator for creating an aerosol, the aerosol being a colloidal dispersion of liquid droplets of the solvent in the gaseous medium; and a droplet eliminator for removing an excess of the liquid droplets of the solvent from the aerosol, the droplet eliminator being arranged in operation such that the droplet eliminator is located downstream of the aerosol generator;

a flow device configured to create a flow of the gaseous medium through the evaporation device; and a transporting mechanism configured to transport a sheet of a recording substrate, the transporting mechanism having an outer surface, wherein the flow device is a suction mechanism arranged to provide an underpressure force at an outer surface of the transporting mechanism.

2. The inkjet marking module according to claim 1, wherein the inkjet marking device comprises a printing region comprising at least one nozzle arranged for expelling droplets of the inkjet marking material to form the image on the recording substrate, and wherein the evaporation device is arranged to provide the gaseous medium comprising solvent vapor in the printing region of the inkjet marking device.

3. The inkjet marking module according to claim 1, wherein the droplet eliminator is a passive droplet eliminator, the passive droplet eliminator comprising a mesh arranged for removing droplets from the aerosol.

4. The inkjet marking module according to claim 1, wherein the droplet eliminator is an active droplet eliminator.

5. The inkjet marking module according to claim 4, wherein the active droplet eliminator comprises a rotatable element, wherein, in operation, the rotatable element is rotated for removing a remainder of the liquid droplets from the aerosol.

6. The inkjet marking module according to claim 5, wherein the rotatable element is a fan, the fan being arranged for advancing the aerosol through the evaporation device.

7. The inkjet marking module according to claim 1, wherein the evaporation device comprises an evaporation chamber arranged downstream of the aerosol generator and upstream of the droplet eliminator.

8. The inkjet marking module according to claim 1, wherein the evaporation device comprises a temperature sensor and a heat exchanger, the evaporation device and the temperature sensor being operatively connected with a temperature controller.

9. The inkjet marking module according to claim 1, wherein the evaporation device further comprises:

a first mass flow controller arranged to control a first mass flow of the gaseous medium substantially saturated with the solvent vapor;

a second mass flow controller arranged to control a second mass flow of the gaseous medium having a vapor pressure of the solvent vapor below the saturation vapor pressure; and a duct arranged downstream of the first mass flow controller and the second mass flow controller and arranged for mixing the first mass flow with the second mass flow.

10. A printing system comprising the inkjet marking module according claim 1.

11. The printing system according to claim 10, further comprising a fixing and drying unit, wherein solvent enriched gaseous medium generated in the fixing and drying unit is transferred to the inkjet marking module.

* * * * *